US010931069B2

(12) United States Patent
Kunz et al.

(10) Patent No.: US 10,931,069 B2
(45) Date of Patent: Feb. 23, 2021

(54) HIGH-DENSITY ELECTRICAL CONNECTOR

(71) Applicant: ATL Technology, LLC, Springville, UT (US)

(72) Inventors: Ryan Kunz, Riverton, UT (US); Braden Ta'ala, Spanish Fork, UT (US); Douglas Sward, Midvale, UT (US)

(73) Assignee: ATL TECHNOLOGY, LLC, Springville, UT (US)

( * ) Notice: Subject to any disclaimer, the term of this patent is extended or adjusted under 35 U.S.C. 154(b) by 78 days.

(21) Appl. No.: 16/399,392

(22) Filed: Apr. 30, 2019

(65) Prior Publication Data

US 2019/0334297 A1 Oct. 31, 2019

Related U.S. Application Data

(60) Provisional application No. 62/664,478, filed on Apr. 30, 2018.

(51) Int. Cl.

| | |
|---|---|
| ***H01R 13/627*** | (2006.01) |
| ***H01R 24/40*** | (2011.01) |
| ***H01R 13/502*** | (2006.01) |
| ***H01R 13/631*** | (2006.01) |
| ***H01R 13/11*** | (2006.01) |

(52) U.S. Cl.

CPC ..... *H01R 24/40* (2013.01); *H01R 13/11* (2013.01); *H01R 13/502* (2013.01); *H01R 13/6271* (2013.01); *H01R 13/631* (2013.01)

(58) Field of Classification Search

CPC ..... H01R 13/6271; H01R 13/6275

USPC ..... 439/352, 660, 675

See application file for complete search history.

(56) References Cited

U.S. PATENT DOCUMENTS

| | | | |
|---|---|---|---|
| 2,396,725 | A | 3/1946 | Thomas et al. |
| 3,718,859 | A | 2/1973 | Arlow |
| 3,853,376 | A | 12/1974 | Marechal |

(Continued)

FOREIGN PATENT DOCUMENTS

| | | |
|---|---|---|
| CN | 204333521 | 5/2015 |
| CN | 205335533 | 6/2016 |

(Continued)

*Primary Examiner* — Phuong K Dinh

(74) *Attorney, Agent, or Firm* — Kunzler Bean & Adamson

(57) ABSTRACT

Disclosed herein is an electrical connector, comprising a plug and a receptacle. The plug comprises first electrical contacts electrically isolated from each other and arranged into a first outer contact annulus and a first inner contact annulus concentric with and radially spaced apart from each other. The receptacle comprises second electrical contacts electrically isolated from each other and arranged into a second outer contact annulus and a second inner contact annulus concentric with and radially spaced apart from each other. The plug is selectively connectable with the receptacle. When the plug is selectively connected with the receptacle, each of the first electrical contacts of the first outer contact annulus is in physical contact with a corresponding one of the second electrical contacts of the second outer contact annulus and each of the first electrical contacts of the first inner contact annulus is in physical contact with a corresponding one of the second electrical contacts of the second inner contact annulus.

20 Claims, 8 Drawing Sheets

(56) References Cited

U.S. PATENT DOCUMENTS

| | | | | |
|---|---|---|---|---|
| 5,026,300 | A | 6/1991 | Varner | |
| 5,181,859 | A | 1/1993 | Foreman et al. | |
| 5,348,498 | A | 9/1994 | Morello et al. | |
| 5,568,348 | A | 10/1996 | Foreman et al. | |
| 5,632,655 | A | 5/1997 | DeMarco | |
| 5,953,815 | A | 9/1999 | Kaminski et al. | |
| 5,993,242 | A | 11/1999 | Zell et al. | |
| 6,652,319 | B1 | 11/2003 | Billman | |
| 7,914,344 | B2 * | 3/2011 | Tin | H01R 24/50 439/675 |
| 7,922,529 | B1 | 4/2011 | Meurer | |
| 9,966,713 | B1 * | 5/2018 | Shaeffer | H01R 24/86 |

FOREIGN PATENT DOCUMENTS

| | | |
|---|---|---|
| GB | 1239070 | 7/1971 |
| JP | 5109435 | 4/1993 |

* cited by examiner

HIGH-DENSITY ELECTRICAL CONNECTOR

CROSS-REFERENCE TO RELATED APPLICATION

This application claims the benefit of U.S. Provisional Patent Application No. 62/664,478, filed Apr. 30, 2018, which is incorporated by reference.

FIELD

This application relates generally to electrical components, and more specifically to an electrical connector having a plug and a receptacle.

BACKGROUND

Conventional high-density electrical connectors include rows of stacked electrical contact boards. Because any one of the boards may unpredictably act as a primary datum, as a plug of the connector is inserted into a receptacle of the connector, misalignment of or unreliable connections between the other of the boards may occur. Accordingly, predictably aligning multiple groupings of electrical contacts in a high-density electrical connector can be difficult.

SUMMARY

The subject matter of the present application has been developed in response to the present state of the art, and in particular, in response to the problems and needs of conventional devices or products for providing a high-density electrical connection between a tool and a tool control system that have not yet been fully solved. The subject matter of the present application has been developed to provide an electrical connector that facilitates a high-density electrical connection that overcomes many of the shortcomings of the prior art.

Disclosed herein is an electrical connector, comprising a plug and a receptacle. The plug comprises first electrical contacts electrically isolated from each other and arranged into a first outer contact annulus and a first inner contact annulus concentric with and radially spaced apart from each other. The receptacle comprises second electrical contacts electrically isolated from each other and arranged into a second outer contact annulus and a second inner contact annulus concentric with and radially spaced apart from each other. The plug is selectively connectable with the receptacle. When the plug is selectively connected with the receptacle, each of the first electrical contacts of the first outer contact annulus is in physical contact with a corresponding one of the second electrical contacts of the second outer contact annulus and each of the first electrical contacts of the first inner contact annulus is in physical contact with a corresponding one of the second electrical contacts of the second inner contact annulus. The preceding subject matter of this paragraph characterizes example 1 of the present disclosure.

The plug comprises a central axis. The first electrical contacts of the first outer contact annulus are resiliently flexible away from the central axis of the plug. The first electrical contacts of the first inner contact annulus are resiliently flexible toward the central axis of the plug. The preceding subject matter of this paragraph characterizes example 2 of the present disclosure, wherein example 2 also includes the subject matter according to example 1, above.

The plug further comprises an outer contact retention annulus comprising first ribs, spaced apart from each other in a circular arrangement, and first slots each between adjacent ones of the first ribs. The plug further comprises an inner contact retention annulus comprising second ribs, spaced apart from each other in a circular arrangement, and second slots each between adjacent ones of the second ribs. Each one of the first electrical contacts of the first outer contact annulus is movably positioned within a corresponding one of the first slots of the outer contact retention annulus. Each one of the first electrical contacts of the first inner contact annulus is movably positioned within a corresponding one of the second slots of the inner contact retention annulus. The preceding subject matter of this paragraph characterizes example 3 of the present disclosure, wherein example 3 also includes the subject matter according to example 2, above.

The receptacle comprises a central axis. The second electrical contacts of the second outer contact annulus are radially fixed relative to the central axis. The second electrical contacts of the second inner contact annulus are radially fixed relative to the central axis. The preceding subject matter of this paragraph characterizes example 4 of the present disclosure, wherein example 4 also includes the subject matter according to any one of examples 2 or 3, above.

An annular space is defined between the first outer contact annulus and the first inner contact annulus of the plug. The receptacle comprises a support ring interposed between and radially supporting the second outer contact annulus and the second inner contact annulus of the receptacle. When the plug is selectively connected with the receptacle, the support ring of the receptacle is inserted into the annular space of the plug. The preceding subject matter of this paragraph characterizes example 5 of the present disclosure, wherein example 5 also includes the subject matter according to any one of examples 1-4, above.

The support ring of the plug comprises an outer contact retention annulus comprising first ribs, spaced apart from each other in a circular arrangement, and first slots each between adjacent ones of the first ribs. The support ring of the plug further comprises an inner contact retention annulus comprising second ribs, spaced apart from each other in a circular arrangement, and second slots each between adjacent ones of the second ribs. Each one of the second electrical contacts of the second outer contact annulus is fixedly positioned within a corresponding one of the first slots of the outer contact retention annulus. Each one of the second electrical contacts of the second inner contact annulus is fixedly positioned within a corresponding one of the second slots of the inner contact retention annulus. The preceding subject matter of this paragraph characterizes example 6 of the present disclosure, wherein example 6 also includes the subject matter according to example 5, above.

The plug further comprises a housing comprising an interior cavity and a contact carrier housed within the housing. The first electrical contacts are non-translationally fixed to the contact carrier and the contact carrier is translationally movable relative to the housing. The preceding subject matter of this paragraph characterizes example 7 of the present disclosure, wherein example 7 also includes the subject matter according to any one of examples 1-6, above.

The housing further comprises an alignment aperture. The contact carrier comprises an alignment tab that extends through and is translationally movable within the alignment aperture. The receptacle comprises an alignment slot. When the plug is selectively connected with the receptacle, the alignment tab of the contact carrier is inserted into the alignment slot of the receptacle. The preceding subject matter of this paragraph characterizes example 8 of the present disclosure, wherein example 8 also includes the subject matter according to example 7, above.

The housing further comprises a retention aperture. The contact carrier further comprises a retention tab that is resiliently flexible and biased to extend through the retention aperture of the housing. The receptacle comprises a recess. When the plug is selectively connected with the receptacle, the retention tab of the contact carrier engages the recess of the receptacle. The preceding subject matter of this paragraph characterizes example 9 of the present disclosure, wherein example 9 also includes the subject matter according to any one of examples 7 or 8, above.

When the plug is selectively connected with the receptacle, translational movement of the housing of the plug relative to the contact carrier of the plug in a direction away from the receptacle, causes the housing to engage and resiliently and radially inwardly deform the retention tab to release the retention tab from the recess. The preceding subject matter of this paragraph characterizes example 10 of the present disclosure, wherein example 10 also includes the subject matter according to example 9, above.

The contact carrier further comprises a central receptacle interface radially inward of the first inner contact annulus. The plug further comprises one of electrical pin receptacles or electrical pins coupled to the central receptacle interface. The receptacle further comprises a central pin interface that comprises another one of the electrical pin receptacles or the electrical pins. When the plug is selectively connected with the receptacle, the electrical pin receptacles are electrically coupled with the electrical pins. The preceding subject matter of this paragraph characterizes example 11 of the present disclosure, wherein example 11 also includes the subject matter according to any one of examples 7-10, above.

The plug further comprises a radio-frequency (RF) shield non-movably fixed to the contact carrier and interposed between the first electrical contacts and the one of the electrical pin receptacles or the electrical pins of the plug. The preceding subject matter of this paragraph characterizes example 12 of the present disclosure, wherein example 12 also includes the subject matter according to example 11, above.

The RF shield comprises two concentric parts that are radially offset from each other and at least partially overlap each other. The preceding subject matter of this paragraph characterizes example 13 of the present disclosure, wherein example 13 also includes the subject matter according to example 12, above.

The receptacle further comprises a radio-frequency (RF) shield non-movably fixed to the receptacle and interposed between the second electrical contacts and the other of the electrical pin receptacles or the electrical pins of the receptacle. The preceding subject matter of this paragraph characterizes example 14 of the present disclosure, wherein example 14 also includes the subject matter according to any one of examples 11-13, above.

The RF shield comprises two concentric parts that are radially offset from each other and at least partially overlap each other. The preceding subject matter of this paragraph characterizes example 15 of the present disclosure, wherein example 15 also includes the subject matter according to example 14, above.

No portion of the first electrical contacts is elastically deformed. The preceding subject matter of this paragraph characterizes example 16 of the present disclosure, wherein example 16 also includes the subject matter according to any one of examples 1-15, above.

Each of the first electrical contacts of the plug comprises a curved contact surface. When the plug is selectively connected with the receptacle, the curved contact surface of each of the first electrical contacts is in electrical contact with a corresponding one of the second electrical contacts of the receptacle. The preceding subject matter of this paragraph characterizes example 17 of the present disclosure, wherein example 17 also includes the subject matter according to any one of examples 1-16, above.

The receptacle further comprises a housing comprising an interior cavity and a contact carrier housed within the housing. The second electrical contacts are non-movably fixed to the contact carrier and the contact carrier is non-movably fixed to the housing. The preceding subject matter of this paragraph characterizes example 18 of the present disclosure, wherein example 18 also includes the subject matter according to any one of examples 1-17, above.

Additionally disclosed herein is a plug of an electrical connector. The plug comprises a first set of electrical contacts electrically isolated from each other and arranged into an outer contact annulus about a central axis of the plug. The plug also comprises a second set of electrical contacts electrically isolated from each other and arranged into an inner contact annulus about the central axis of the plug. The inner contact annulus is concentric with and radially spaced apart from the outer contact annulus. The first set of electrical contacts of the outer contact annulus are resiliently flexible away from the central axis of the plug. The second set of electrical contacts of the first inner contact annulus are resiliently flexible toward the central axis of the plug. The preceding subject matter of this paragraph characterizes example 19 of the present disclosure.

Also disclosed herein is a receptacle of an electrical connector. The receptacle comprises a support ring concentric with a central axis of the receptacle and comprising a radially outward surface and a radially inward surface. The receptacle also comprises a first set of electrical contacts supported on the radially outward surface of the support ring, electrically isolated from each other, and arranged into an outer contact annulus about the central axis of the receptacle. The receptacle further comprises a second set of electrical contacts supported on the radially inward surface of the support ring, electrically isolated from each other, and arranged into an inner contact annulus about the central axis. The inner contact annulus is concentric with the outer contact annulus. The support ring is interposed between the inner contact annulus and the outer contact annulus. The first set of electrical contacts of the outer contact annulus are radially fixed relative to the central axis. The second set of electrical contacts of the inner contact annulus are radially fixed relative to the central axis. The preceding subject matter of this paragraph characterizes example 20 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
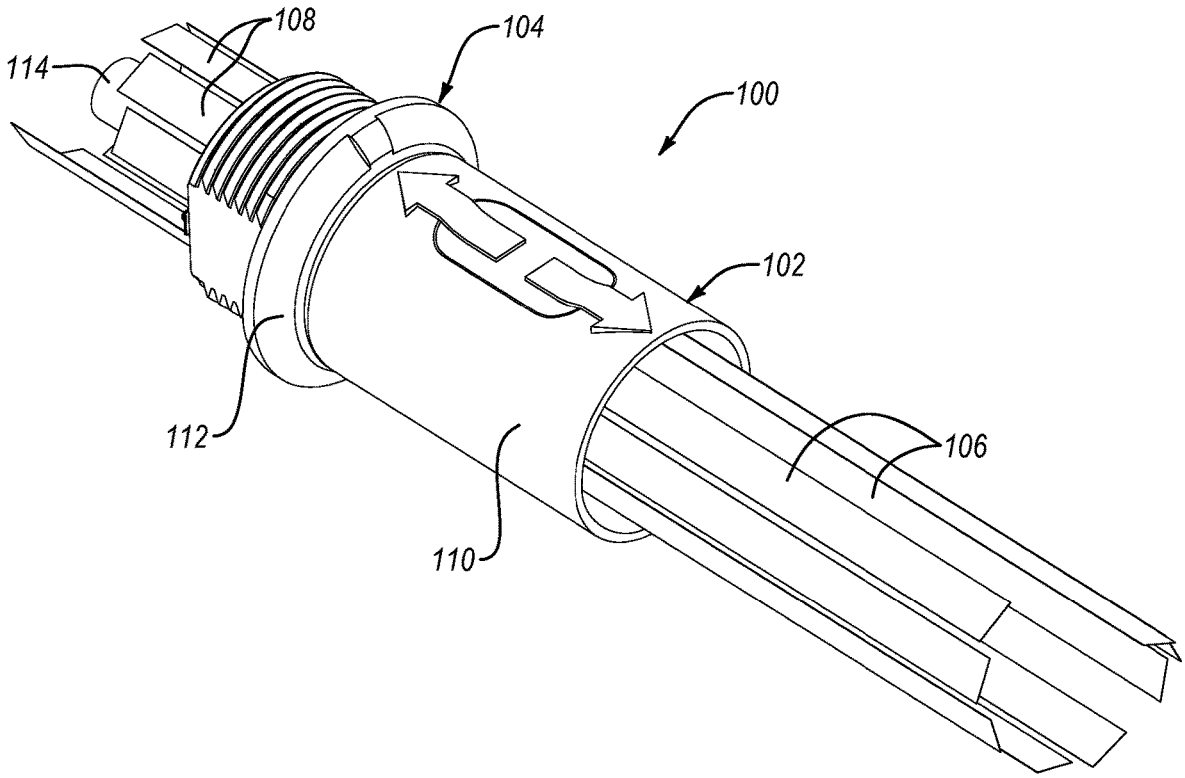
FIG. 1 illustrates a perspective view of an electrical connector, shown with a plug of the electrical connector connected to a receptacle of the electrical connector, according to one or more examples of the present disclosure.
Figure 2:
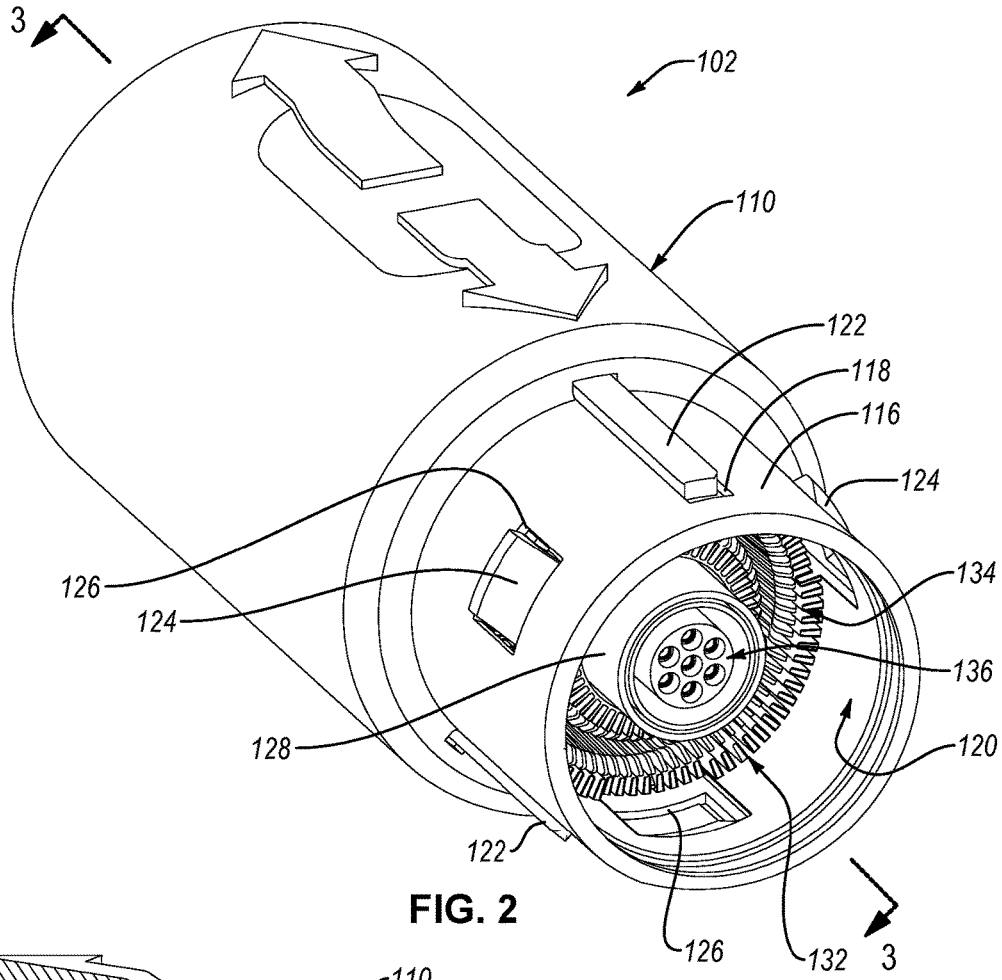
FIG. 2 illustrates a perspective view of a plug of an electrical connector, according to one or more examples of the present disclosure.

Referring to FIG. 1, one embodiment of an electrical connector 100 includes a plug 102 and a receptacle 104. The electrical connector 100 is considered a high-density electrical connector because the electrical connector 100 has a high density of electrical contacts or terminals each configured to transmit electrical signals between the plug 102 and the receptacle 104 when connected. Generally, the majority of the electrical contacts of the electrical connector 100 are arranged circumferentially or annularly about a common axis (e.g., central axis 195 of FIGS. 3 and 7). Coaxial and rotational alignment of the plug 102 and the receptacle 104 ensures proper alignment of corresponding electrical contacts of the plug 102 and the receptacle 104. Moreover, coaxial and rotational alignment of the plug 102 and the receptacle 104 is based on initial alignment of a single, predictable primary datum independent of the electrical contacts. Such a configuration is advantageous over conventional high-density electrical connectors with rows of stacked electrical contact boards because any one of the boards may unpredictably act as the primary datum, which may result in a misalignment of or unreliable connections between the other of the boards.

Figure 3:
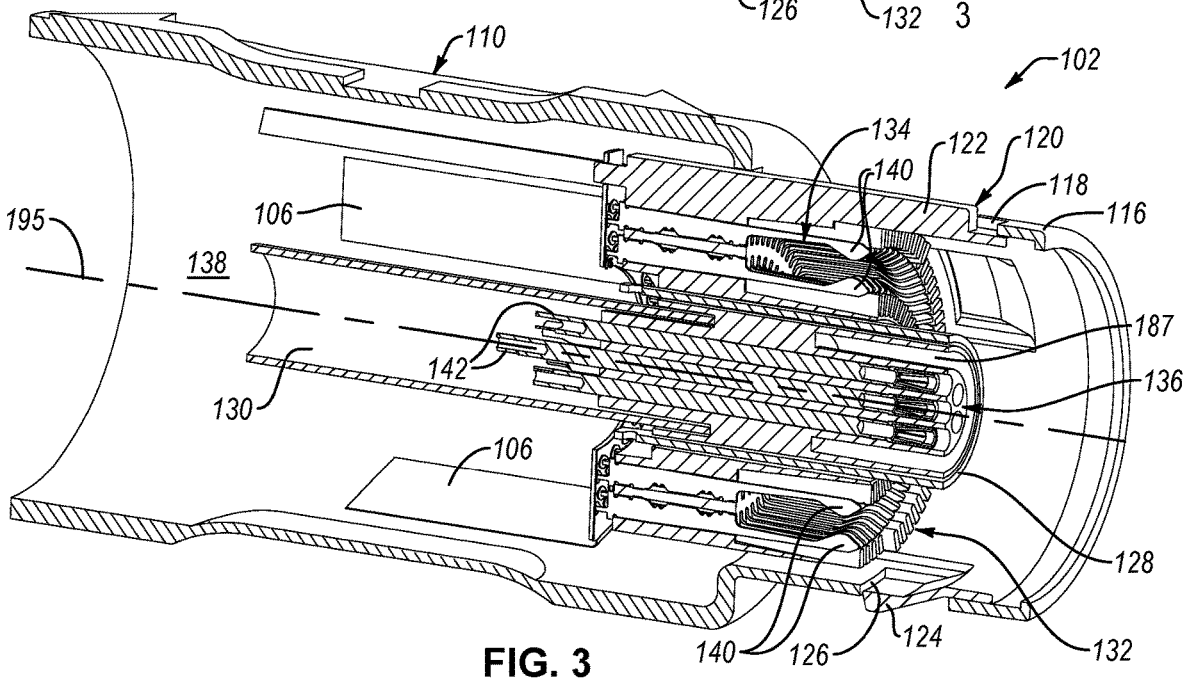
FIG. 3 illustrates a cross-sectional perspective view of the plug of FIG. 2, taken along the line 3-3 of FIG. 2, according to one or more examples of the present disclosure.

The plug 102 includes a housing 110 and circuit boards 106 extending from the housing 110. The circuit boards 106 may include electrical traces imprinted on an electrically-insulating substrate. Moreover, in some implementations, the circuit boards 106 can be flexible circuit boards. Each circuit board 106 is electrically coupled to one or more electrical contacts of the plug 102 at one end and other electrical connections (not shown), such as those of a medical tool, at an opposite end. As shown in FIGS. 2-5, the housing 110 includes an engagement end portion 116 with a reduced outer peripheral diameter relative to the rest of the housing 110. The engagement end portion 116 includes alignment apertures 118 and retention apertures 126 spaced apart about the periphery of the engagement end portion 116. As shown in FIG. 3, the housing 110 defines an interior cavity 138 accessible through the alignment apertures 118 and the retention apertures 126.

The plug 102 further includes a contact carrier 120 housed within the interior cavity 138 of the housing 110 at the engagement end portion 116. The engagement end portion 116 retains the contact carrier 120, but allows the contact carrier 120 to translationally shift along the central axis 195. For example, the contact carrier 120 includes retention tabs 124 that are resiliently flexible and biased to extend through and beyond corresponding retention apertures 126 in the engagement end portion 116 to releasably couple or retain the contact carrier 120 to the engagement end portion 116. In this position, the retention tabs 124 are positioned to engage corresponding recesses 160 in the receptacle 104

(see, e.g., FIG. 7), which releasably connects the plug 102 to the receptacle 104. Translational movement of the housing 110 relative to the contact carrier 120, in a direction away from the receptacle 104, causes an edge of the retention apertures 126 to engage and resiliently flex corresponding retention tabs 124 inwardly toward the interior cavity 138. Such flexing of the retention tabs 124 disengages the retention tabs 124 from corresponding recesses 160 in the receptacle 104 (see, e.g., FIG. 7), which allows the plug 102 to be disconnected from the receptacle 104.

Although in the illustrated example, the plug 102 is releasably connected to the receptacle 104 via a passive latch mechanism comprising the retention tabs 124 and the recesses 160, as described above, in other examples, the plug 102 is releasably connected to the receptacle 104 via other coupling mechanisms, such as active latch mechanisms, friction latch mechanisms, and the like.

The contact carrier 120 also includes alignment tabs 122 that extend through and radially outwardly beyond the alignment apertures 118 in the engagement end portion 116. The alignment tabs 122 are allowed to translationally move parallel with the central axis 195 within the alignment apertures 118, but the alignment apertures 118 constrain movement of the alignment tabs 122 in directions perpendicular to the central axis 195. The alignment tabs 122 are circumferentially spaced apart from each other about the engagement end portion 116. The alignment tabs 122 are configured to engage corresponding alignment slots 158 of the plug 102 to ensure proper alignment between the plug 102 and the receptacle 104. Because alignment between the plug 102 and the receptacle 104 is controlled by the alignment tabs 122 of the contact carrier 120, rather than some feature of the housing 110, alignment tolerances are reduced by effectively by-passing the housing 110.

Figure 5:
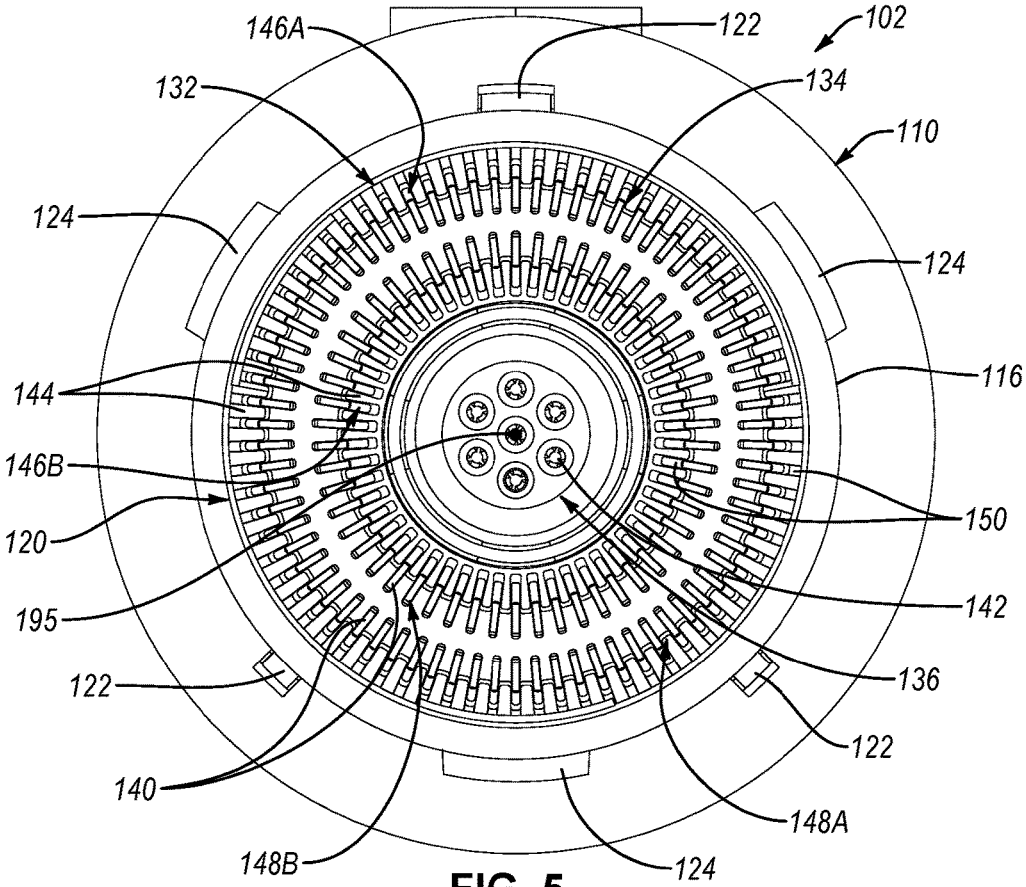
FIG. 5 illustrates a front view of the plug of FIG. 2, according to one or more examples of the present disclosure.
Figure 6:
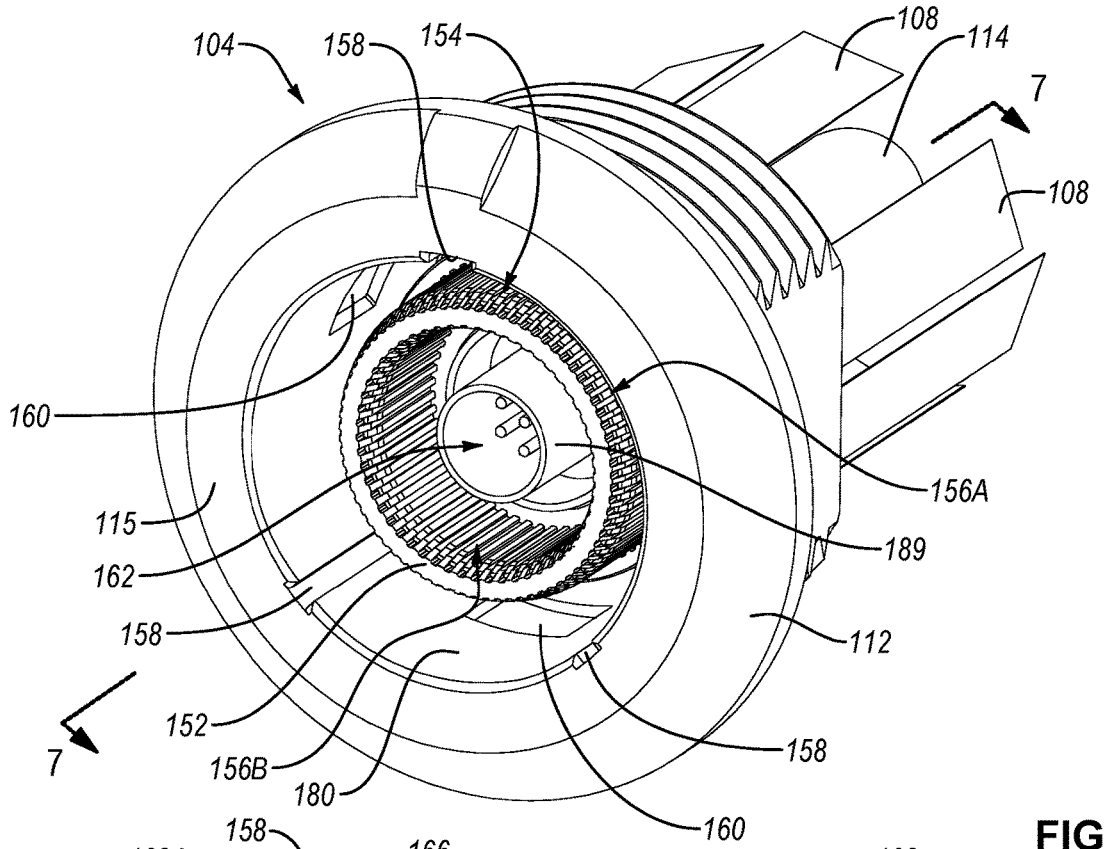
FIG. 6 illustrates a perspective view of a receptacle of an electrical connector, according to one or more examples of the present disclosure.

As shown in FIG. 5, one or more of the alignment tabs 122 can have a width that is different than the width of another one or more of the alignment tabs 122. In the illustrated example, the width of the alignment tab 122 at the top of the plug 102, as shown in FIG. 5, is wider than the two alignment tables 122 nearer the bottom of the plug 102, as shown in FIG. 5. The alignment slots 158 in the receptacle 104 have the same pattern and sizing as the alignment tabs 122. Accordingly, the wider alignment tab 122 can act as a key feature to ensure the plug 102 is properly rotationally oriented relative to the receptacle 104 when the two are mated together. Although the alignment tabs 122 of the illustrated example are arranged in a particular circumferential pattern (e.g., evenly spaced) and have a particular size (e.g., one wider than two others), in other examples, the alignment tabs 122, and corresponding alignment slots 158, can be arranged in any of various particular or unique circumferential patterns and have any of various particular or unique sizing to help facilitate connections only between plugs and receptacles that have matching patterns and sizing.

Figure 4:
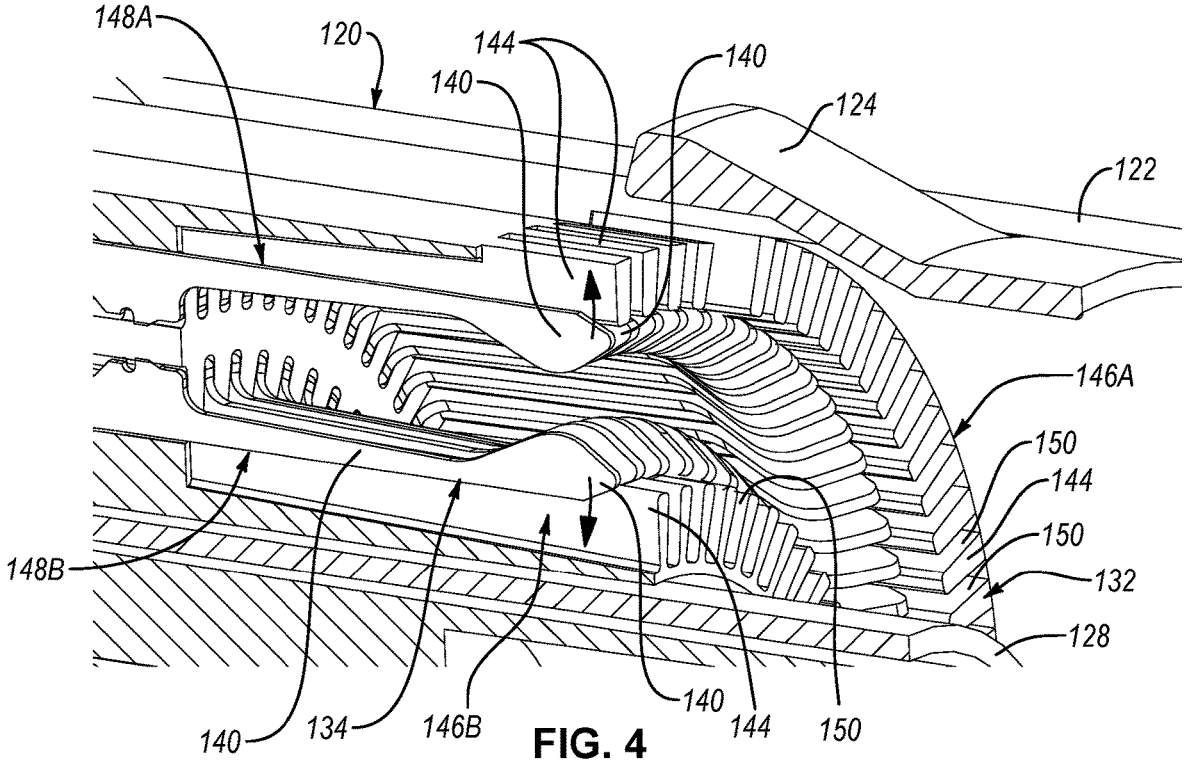
FIG. 4 illustrates a cross-sectional perspective view of a portion of a contact carrier of a plug of an electrical connector, according to one or more examples of the present disclosure.

Referring to FIG. 4, the contact carrier 120 also includes an outer contact retention annulus 146A and an inner contact retention annulus 146B. Both the outer contact retention annulus 146A and the inner contact retention annulus 146B are concentric with the central axis 195 and thus are concentric with each other. Each of the outer contact retention annulus 146A and the inner contact retention annulus 146B includes a plurality of ribs 144 spaced apart from each other about a circumference of the corresponding outer contact retention annulus 146A and inner contact retention annulus 146B. In other words, the ribs 144 of each annulus are arranged in a circular or ring-like arrangement about the central axis 195. Defined between adjacent ribs 144 of the outer contact retention annulus 146A and the inner contact retention annulus 146B are corresponding slots 150. The spacing of the ribs 144, and thus the width of the slots 150, is selected to allow a corresponding electrical contact 140 to move, within a slot 150, radially outward away from the central axis 195 and radially inward toward the central axis 195 (see, e.g., directional arrows in FIG. 4) and to prevent or restrict the corresponding electrical contact 140 from moving laterally in a circumferential direction. Accordingly, the electrical contacts 140 are allowed to flex radially while remaining within the slots 150 and constrained in a fixed angular position, which promotes electrical isolation between the electrical contacts 140 and proper positioning for contacting the electrical contacts 166 of the receptacle 104.

The outer contact retention annulus 146A is larger (e.g., has a larger diameter) than the inner contact retention annulus 146B such that an annular gap is defined between the outer contact retention annulus 146A and the inner contact retention annulus 146B. The gap is configured to receive the annular-shaped contact support ring 152 of the receptacle 104, as will be further defined below. The slots 150 of the outer contact retention annulus 146A are open towards the central axis 195 and the slots 150 of the inner contact retention annulus 146B are open away from the central axis 195.

The electrical contacts 140 of the plug 102 form a group 134 of electrical contacts 140. The group 134 of electrical contacts 140 are arranged into an outer contact annulus 148A and an inner contact annulus 148B each concentric with the central axis 195. The electrical contacts 140 of the outer contact annulus 148A are circumferentially spaced apart from each other and collectively define an annular-shaped grouping of contacts 140. Accordingly, the electrical contacts 140 are electrically isolated from each other. Similarly, the electrical contacts 140 of the inner contact annulus 148B are circumferentially spaced apart from each other and collectively define an annular-shaped grouping of electrical contacts 140. The outer contact annulus 148A is larger than the inner contact annulus 148B. In other words, the electrical contacts 140 of the outer contact annulus 148A are all positioned a first distance away from the central axis 195 and the electrical contacts 140 of the inner contact annulus 148B are all positioned a second distance away from the central axis 195, where the first distance is greater than the second distance. In some implementations, the outer contact annulus 148A includes at least twenty-five electrical contacts 140 (e.g., at least seventy-four electrical contacts 140). The inner contact annular 148B includes fewer electrical contacts 140 than the outer contact annulus 148A. For example, in some implementations, the inner contact annulus 148B includes between forty and sixty (e.g., fifty-four) electrical contacts 140.

Figure 12:
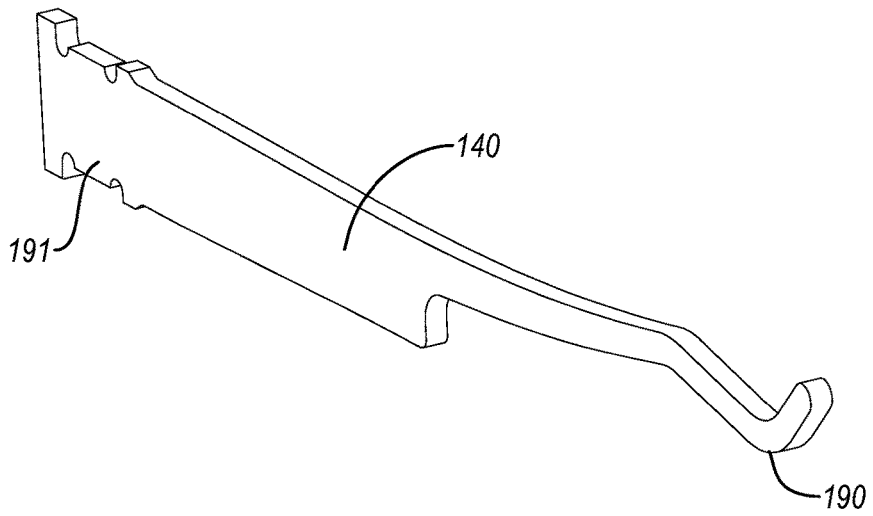
FIG. 12 is a perspective view of an electrical contact of an electrical connector, according to one or more examples of the present disclosure.

Referring to FIG. 12, each electrical contact 140 includes a fixed end 191 and a free end 190 (e.g., cantilevered end). The electrical contact 140 is configured to facilitate resilient flexing of the free end 190 relative to the fixed end 191. Accordingly, in some implementations, a thickness of the electrical contact 140 at a location between the fixed end 191 and the free end 190 is less to define a flex point at that location. The fixed end 191 is configured to be non-movably fixedly secured to contact carrier 120 (see, e.g., FIG. 3) such that the free end 190 is partially positioned within a corresponding slot 150. In other words, a portion of the free end 190 is within the slot 150 and another portion of the free end 190 is out of the slot 150. In this manner, the free end 190 is properly aligned by the ribs 144 defining the slot 150 at the same time as being exposed for establishing electrical contact with an electrical contact 166 of the receptacle 104. In some implementations, the free end 190 includes a concave or curved contact surface to promote electrical connectivity with and slidability along the electrical contact 166. According to one example, as shown in FIG. 12, the free end 190 is substantially U-shaped.

The electrical contacts 140 are made from an electrically conducting material, such as copper. Moreover, in one implementation, the electrical contacts 140 are made using a metal stamping process. For example, each electrical contact 140 can be formed by stamping without a subsequent bending of the electrical contact 140. In other words, no portion of the electrical contact 140 is plastically deformed. Because bending of the electrical contact 140 is not necessary, electrical contact 140 can be smaller and formed at a lower cost, with a more fine-tuned moment of inertia, and with more controlled tolerances compared to stamped and bent electrical contacts.

In one embodiment, the contact carrier 120 defines an annular slot 187 that is concentric with the central axis 195. The annular slot 187 is located radially inwardly from the inner contact retention annulus 146B. Moreover, the annular slot 187 encircles a central receptacle interface 136. The central receptacle interface 136 is concentric with the central axis 195 and includes a plurality of spaced-apart electrical pin receptacles 142. The electrical pin receptacles 142 are positioned within corresponding channels formed in the central receptacle interface 136. Although not shown, the electrical pin receptacles 142 are electrically coupled to other electrical connections, such as those of a medical tool, commercial tool, or other device, at an opposite end. The central receptacle interface 136 can have any number of electrical pin receptacles 142. For example, in FIGS. 2 and 5, the central receptacle interface 136 has eight electrical pin receptacles 142. However, in other examples, the central receptacle interface 136 can have fewer than eight electrical pin receptacles 142 (e.g., one to seven electrical pin receptacles 142) or more than eight electrical pin receptacles 142 (e.g., twelve, eighteen, or more electrical pin receptacles 142). The electrical pin receptacles 142 are made of an electrically conductive material. In one implementation, the electrical pin receptacles 142 are configured to transmit electrical power and the electrical contacts 140 are configured to transmit electrical communication signals.

Although the central receptacle interface 136 in the illustrated embodiment facilitates electrical connections, in other embodiments, the central receptacle interface 136 may be modified to facilitate connections of other types, such as fiber optic, fluidic, pneumatic, and the like. Accordingly, in some implementations, the central receptacle interface 136 can be interchangeable or reconfigurable to meet any of various interconnect capabilities, such as those demanded by a customer. Furthermore, in some implementations, the central receptacle interface 136 can be non-removably fixed to or selectively removably coupled to the contact carrier 120. Interchangeability can be facilitated through the use of selectively releasable interlocking elements, such as clips, tabs, detents, etc., interference fit coupling, and/or any of various other like elements.

Additionally, in some implementations, the contact carrier 120 includes one or more radio-frequency (RF) interference shields configured to block RF interference or noise. For example, the shields can prevent RF interference generated by the transmission of electrical power through the electrical pin receptacles 142 from interfering with the electrical communication signals transmitted through the electrical contacts 140. Referring to FIG. 3, the contact carrier 120 includes a first RF interference shield 128 and a second RF interference shield 130 that are concentric with and partially overlap each other. Although two RF interference shields are shown, in some implementations, the contact carrier 120 can include one or more than two RF interference shields. In one implementation, the RF interference shields are made of a Mu-metal (e.g., a nickel-iron alloy with high permeability).

Figure 11:
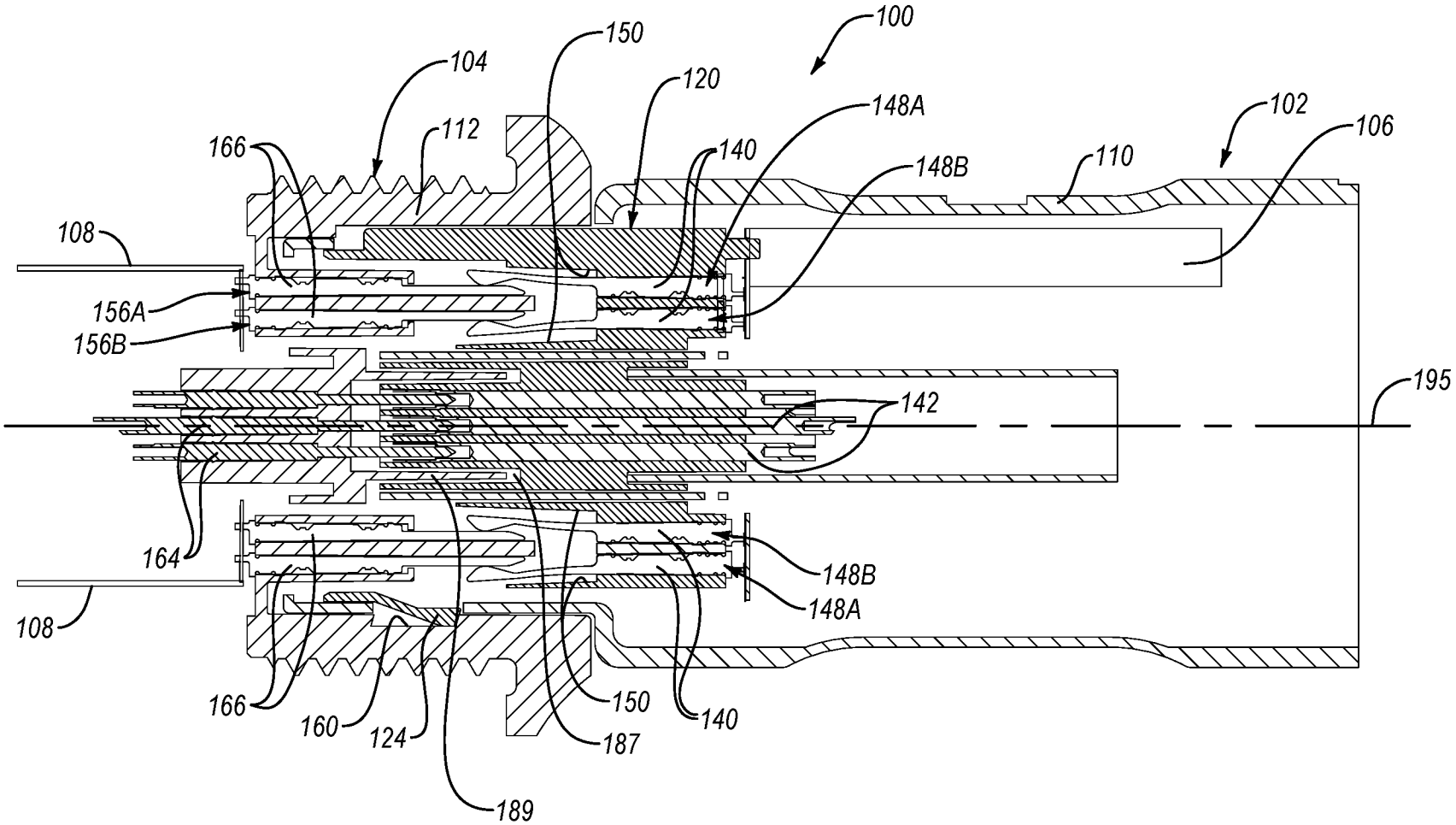
FIG. 11 illustrates a cross-sectional side elevation view of an electrical connector, shown with a plug of the electrical connector connected to a receptacle of the electrical connector, according to one or more examples of the present disclosure.

Referring back to FIG. 1, the receptacle 104 of the electrical connector 100 includes a housing 112 and circuit boards 108 extending from the housing 112. The circuit boards 108 may include electrical traces imprinted on an electrically-insulating substrate. Moreover, in some implementations, the circuit boards 108 can be flexible circuit boards. Each circuit board 108 is electrically coupled to one or more electrical contacts of the receptacle 104 at one end and other electrical connections (not shown), such as those of a control system for a medical tool, commercial tool, or other device, at an opposite end. As shown in FIGS. 6, 7, 9, and 10 the receptacle 104 includes an engagement socket 115 sized and shaped to complement the engagement end portion 116 of the plug 102. The engagement socket 115 is at least partially defined by the housing 112. For example, the engagement socket 115 is configured to matingly receive the engagement end portion 116 of the plug 102 as shown in FIG. 11. The engagement socket 115 includes alignment slots 158 and retention recesses 160 spaced apart about the periphery of the engagement socket 115. Each of the alignment slots 158 is configured to matingly engage a corresponding one of the alignment tabs 122 of the plug 102 and each of the retention recesses 160 is configured to matingly engage a corresponding one of the retention tabs 124 of the plug 102.

The receptacle 104 further includes a contact carrier 180 housed within an interior cavity of the housing 112. The contact carrier 180 can be non-removably fixed to or selectively removably coupled to the housing 112. In some examples, the contact carrier 180 is non-movably fixed to the housing 112. Moreover, the contact carrier 180 at least partially defines the engagement socket 115 of the receptacle 104. In some implementations, the contact carrier 180 is substantially contiguous with the engagement socket 115 of the housing 112 and, in effect, is a continuation of the engagement socket 115 such that the housing 112 and the contact carrier 180 collectively form the engagement socket 115. Alternatively, in certain implementations, the housing 112 and the contact carrier 180 are co-formed to have a one-piece, seamless, monolithic construction. The contact carrier 180 further includes cut-outs 182 that form part of the alignment slots 158 of the engagement socket 115. The contact carrier 180 also includes apertures 196 that partially define the retention recesses 160 of the engagement socket 115.

The contact carrier 180 of the receptacle 104 additionally includes a contact support ring 152 that is concentric with the central axis 195 of the electrical connector 100. Formed into the outer circumference of the contact support ring 152 is an outer contact retention annulus 168A. Additionally, formed into the inner circumference of the contact support ring 152 is an inner contact retention annulus 168B. Both the outer contact retention annulus 168A and the inner contact retention annulus 168B of the receptacle 103 is concentric with the central axis 195 and with each other. Each of the outer contact retention annulus 168A and the inner contact retention annulus 168B includes a plurality of ribs 170 spaced apart from each other about a circumference of the corresponding outer contact retention annulus 168A and inner contact retention annulus 168B. In other words, the ribs 170 of each annulus are arranged in a circular or ring-like arrangement about the central axis 195. Defined between adjacent ribs 170 of the outer contact retention annulus 168A and the inner contact retention annulus 168B are corresponding slots 178. The spacing of the ribs 170, and thus the width of the slots 178, is selected to allow a corresponding electrical contact 166 to remain radially and laterally fixed relative to the central axis 195. In other words, the outer contact retention annulus 168A and the inner contact retention annulus 168B prevent or restrict radial movement of the electrical contacts 166 toward or away from, respectively, the central axis 195, and prevent or restrict the electrical contacts 166 from moving laterally in a circumferential direction. Accordingly, the electrical contacts 166 are constrained in a fixed radial and angular position, which promotes electrical isolation between the electrical contacts 166 and proper positioning for contacting the electrical contacts 140 of the plug 102.

The outer contact retention annulus 168A is larger (e.g., has a larger diameter) than the inner contact retention annulus 168B such that a thickness of the contact support ring 152 is interposed between the outer contact retention annulus 168A and the inner contact retention annulus 168B. The thickness of the contact support ring 152 between the outer contact retention annulus 168A and the inner contact retention annulus 168B is sized to fit within the gap between the outer contact retention annulus 146A and the inner contact retention annulus 146B of the plug 102. The slots 178 of the outer contact retention annulus 168A are open away from the central axis 195 and the slots 178 of the inner contact retention annulus 168B are open toward from the central axis 195.

The electrical contacts 166 of the receptacle 104 form a group of electrical contacts 166. The group of electrical contacts 166 are arranged into an outer contact annulus 156A and an inner contact annulus 156B each concentric with the central axis 195. The electrical contacts 166 of the outer contact annulus 156A are circumferentially spaced apart from each other and collectively define an annular-shaped grouping of contacts 166. Accordingly, the electrical contacts 166 are electrically isolated from each other. Similarly, the electrical contacts 166 of the inner contact annulus 156B are circumferentially spaced apart from each other and collectively define an annular-shaped grouping of electrical contacts 166. The outer contact annulus 156A is larger than the inner contact annulus 156B. In other words, the electrical contacts 166 of the outer contact annulus 156A are all positioned a third distance away from the central axis 195 and the electrical contacts 166 of the inner contact annulus 156B are all positioned a fourth distance away from the central axis 195, where the third distance is greater than the fourth distance. The third distance corresponds with (e.g., is the same as) the first distance between the electrical contacts 140 of the outer contact annulus 148A and the central axis 195, and the fourth distance corresponds with (e.g., is the same as) the second distance between the electrical contacts 140 of the inner contact annulus 148B and the central axis 195.

In some implementations, the outer contact annulus 156A includes at least twenty-five electrical contacts 166 (e.g., at least seventy-four electrical contacts 166). The inner contact annular 156B includes fewer electrical contacts 166 than the outer contact annulus 156A. For example, in some implementations, the inner contact annulus 156B includes between forty and sixty (e.g., fifty-four) electrical contacts 166.

Figure 7:
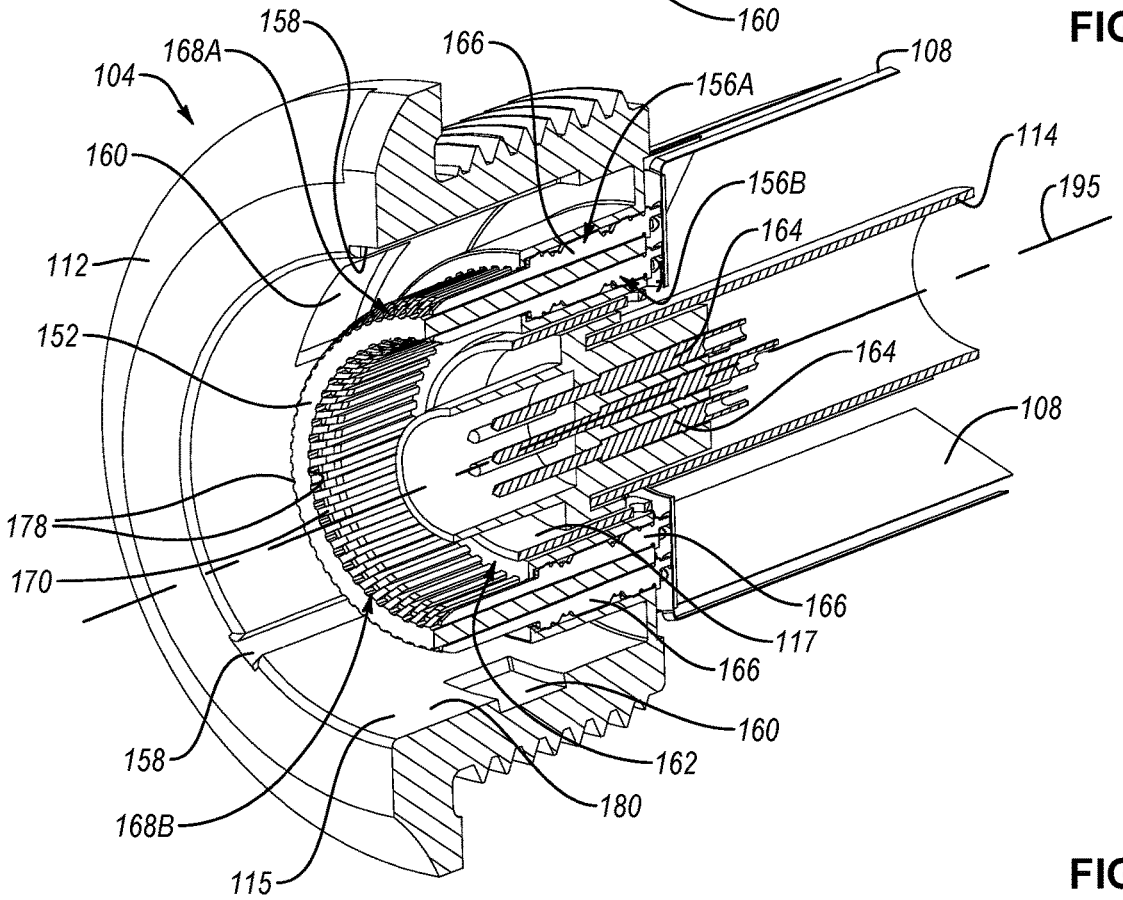
FIG. 7 illustrates a cross-sectional perspective view of the receptacle of FIG. 6, taken along the line 7-7 of FIG. 6, according to one or more examples of the present disclosure.
Figure 13:
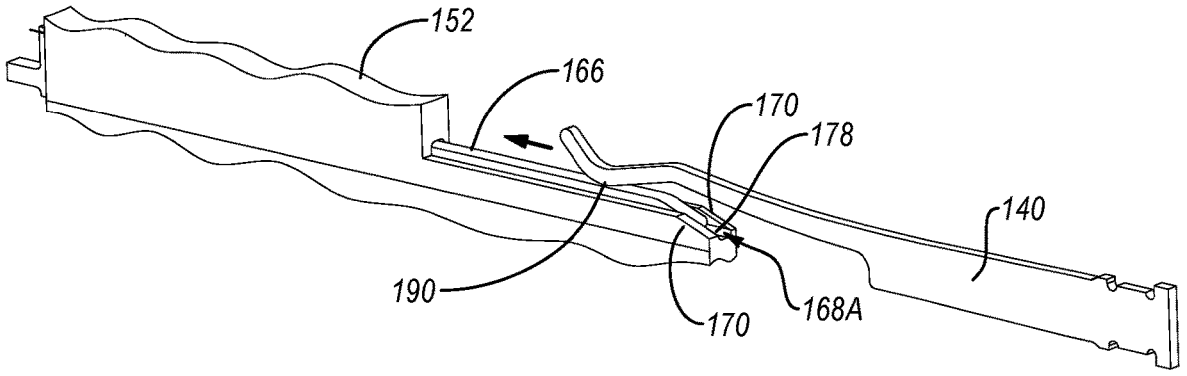
FIG. 13 is a perspective view of an electrical contact of a plug in contact with an electrical contact of a receptacle, according to one or more examples of the present disclosure.

Referring to FIGS. 7 and 13, each electrical contact 166 includes an unexposed fixed end, electrically coupled to one of the circuit boards 108, and an exposed fixed end. The exposed fixed end of each electrical contact 166 can be beveled or tapered to facilitate smooth physically coupling of a corresponding electrical contact 140 of the plug 102. Moreover, adjacent the exposed fixed end is a substantially flat portion along which a corresponding electrical contact 140 slides as the plug 102 is inserted into the receptacle 104 (see, e.g., FIG. 13).

The electrical contacts 166 are made from an electrically conducting material, such as copper. Moreover, in one implementation, the electrical contact 140 is made using a metal stamping process.

In one embodiment, the contact carrier 180 defines an annular tube 189 that is concentric with the central axis 195. The annular tube 189 is located radially inwardly from the inner contact retention annulus 156B. Moreover, the annular tube 189 encircles a central pin interface 162. However, in other embodiments, instead of an annular tube 189, the contact carrier 180 may have a central engagement element that is configured to engage a corresponding engagement element formed in the contact carrier 120 of the plug 102.

The central pin interface 162 is concentric with the central axis 195 and includes a plurality of spaced-apart electrical pins 164. The electrical pins 164 are positioned within corresponding channels formed in the central pin interface 162. Although not shown, the electrical pins 164 are electrically coupled to other electrical connections (not shown), such as those of a medical tool control system. The central pin interface 162 can have any number of electrical pins 164. For example, in FIG. 10, the central pin interface 162 has eight electrical pins 164. However, in other examples, the central pin interface 162 can have fewer than eight electrical pins 164 (e.g., one to seven electrical pins 164) or more than eight electrical pins 164 (e.g., twelve, eighteen, or more electrical pins 164). The electrical pins 164 are made of an electrically conductive material. In one implementation, the electrical pins 164 are configured to transmit electrical power and the electrical contacts 166 are configured to transmit electrical communication signals. It is recognized that, in alternative examples, the plug 102 includes the electrical pins 164 and the receptacle 104 includes the electrical pin receptacles 142.

Although the central pin interface 162 in the illustrated embodiment facilitates electrical connections, in other embodiments, the central pin interface 162 may be modified to facilitate connections of other types, such as fiber optic, fluidic, pneumatic, and the like. Accordingly, in some implementations, the central pin interface 162 can be interchangeable or reconfigurable to meet any of various interconnect capabilities, such as those demanded by a customer. Furthermore, in some implementations, the central pin interface 162 can be non-removably fixed to or selectively removably coupled to the housing 112 or the contact carrier 180.

Figure 9:
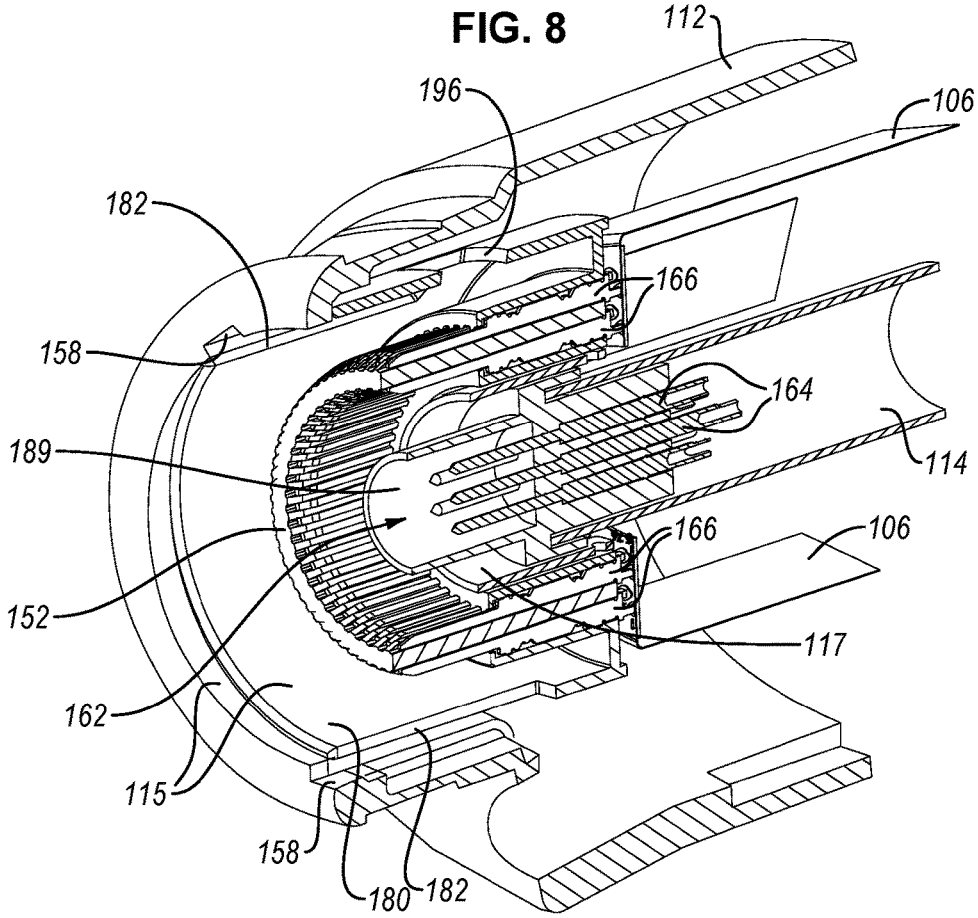
FIG. 9 illustrates a cross-sectional perspective view of a plug of an electrical connector, according to one or more examples of the present disclosure.
Figure 10:
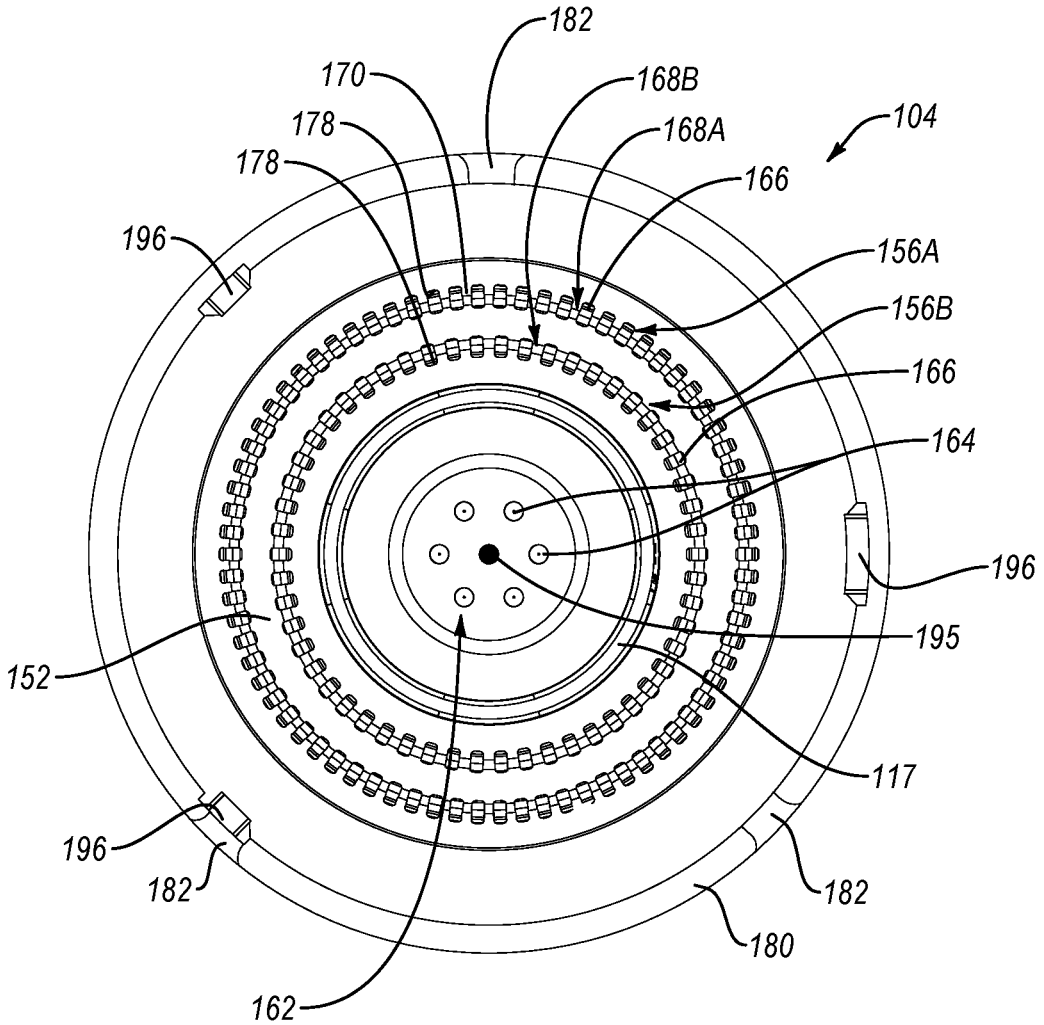
FIG. 10 illustrates a front view of the receptacle of FIG. 6, according to one or more examples of the present disclosure.

Additionally, in some implementations, the contact carrier 180 includes one or more radio-frequency (RF) interference shields configured to block RF interference or noise. For example, the shields can prevent RF interference generated by the transmission of electrical power through the electrical pins 164 from interfering with the electrical communication signals transmitted through the electrical contacts 166. Referring to FIGS. 7 and 9, the contact carrier 120 includes a first RF interference shield 114 and a second RF interference shield 117 that are concentric with and partially overlap each other. Although two RF interference shields are shown, in some implementations, the contact carrier 180 can include one or more than two RF interference shields. In one implementation, the RF interference shields are made of a Mu-metal.

The housing 110, contact carrier 120, housing 112, and contact carrier 180 can be made from electrically non-conductive materials, such as plastics.

Figure 8:
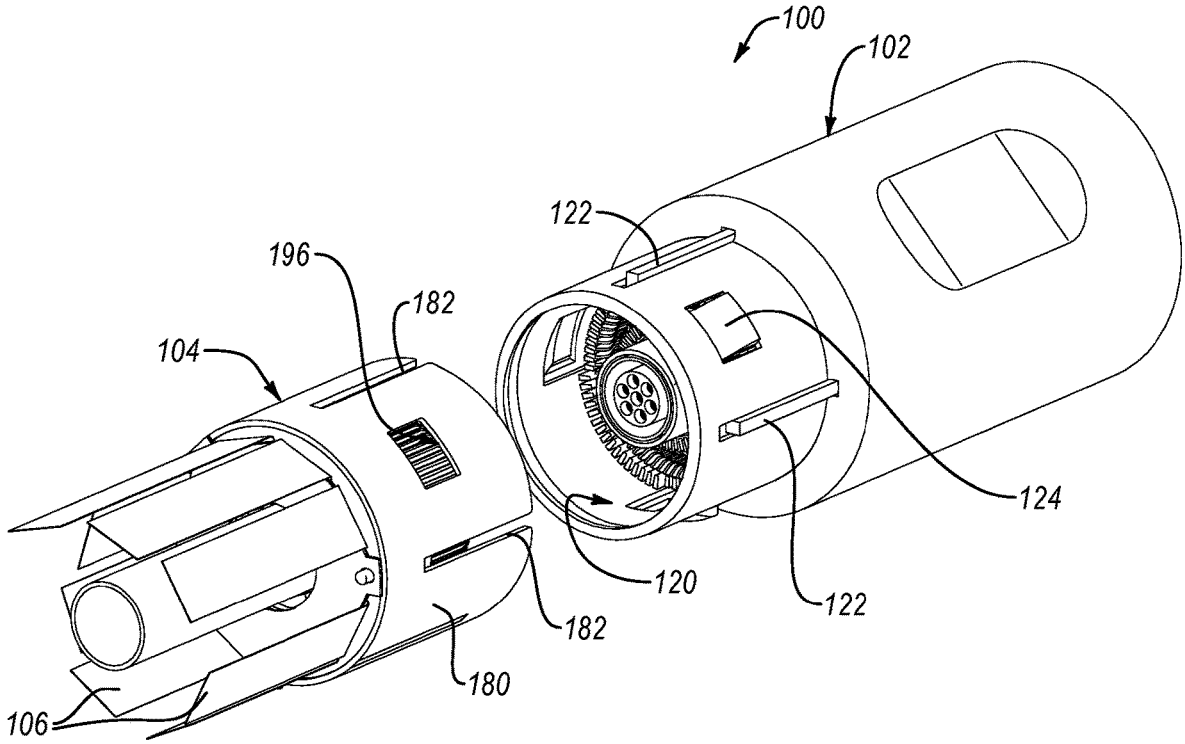
FIG. 8 illustrates a perspective view of a plug and a contact carrier of a receptacle of an electrical connector, according to one or more examples of the present disclosure.

Referring to FIG. 11, the plug 102 is shown inserted into the receptacle 104 to establish electrical connectivity between the plug 102 and the receptacle 104. The process of inserting the plug 102 into the receptacle 104 and establishing electrical connectivity between the plug 102 and the receptacle 104 is initiated by bringing the plug 102 into at least approximate coaxial alignment with the receptacle 104, such as shown in FIG. 8. Additionally, the plug 102 and the receptacle 104 rotationally oriented relative to each other until the alignment tabs 122 of the plug 102 are aligned with the alignment slots 158. When aligned, the plug 102 and the receptacle 104 can be moved toward each other, as indicated by directional arrows in FIG. 8, until the alignment tabs 122 are inserted into the alignment slots 158. Engagement between the alignment tabs 122 of the plug 102 and the alignment slots 158 ensures proper alignment between the plug 102 and the receptacle 104 by establishing an orientation datum with the contact carrier 120, thus reducing tolerance stack between the plug 102 and the receptacle 104.

Further insertion of the plug 102 into the receptacle 104 causes the annular tube 189 of the receptacle 103 to engage and the annular slot 187 of the plug 102. Yet further insertion of the plug 102 into the receptacle results in the electrical contacts 140 contacting the electrical contacts 166. Such contact causes the electrical contracts 140 to radially flex, which ensures proper contact between the electrical contacts 140 and the electrical contacts 166. As the plug 102 is further inserted into the receptacle 104, the electrical contacts 140 slide along corresponding electrical contacts 166, which helps to decontaminate the electrical contacts and ensures a reliable stable connection between the electrical contacts. Such a slidable arrangement also promotes a lower insertion force for connection between the contacts to be established. After the annular tube 189 engages the annular slot 187, further insertion of the plug 102 into the receptacle 104 results in the electrical pins 164 being inserted into corresponding electrical pin receptacles 142.

Full insertion of the plug 102 into the receptacle 104 allows the retention tabs 124 of the plug 102 to recoil into corresponding ones of the retention recesses 160 of the receptacle 104, thus releasably fixing the plug 102 in interconnecting engagement with the receptacle 104. When disconnection of the plug 102 from the receptacle 104 is desired, the housing 110 is slid relative to the contact carrier 120 in a direction away from the receptacle 104 until the housing 110 engages the retention tabs 124 and resiliently flexes the retention tabs 124 out of engagement with the retention recesses 160. With the retention tabs 124 disengaged from the retention recesses 160, the plug 102 can be moved away from the receptacle 104 to disconnect the plug 102 from the receptacle 104.

Although the plug 102 includes the electrical contacts 140, the annular alignment slot 187, and the electrical pin receptacles 142, and the receptacle 104 includes the electrical contacts 166, the annular tube 189, and the electrical pins 164, in some embodiments, the plug 102 includes the electrical contacts 166, the annular tube 189, and the electrical pins 164, and the receptacle 104 includes the electrical contacts 140, the annular slot 187, and the electrical pin receptacles 142 without departing from the essence of the present disclosure.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An electrical connector, comprising:

a plug comprising first electrical contacts electrically isolated from each other and arranged into a first outer contact annulus and a first inner contact annulus concentric with and radially spaced apart from each other; and a receptacle comprising second electrical contacts electrically isolated from each other and arranged into a second outer contact annulus and a second inner contact annulus concentric with and radially spaced apart from each other;

wherein:

the plug is selectively connectable with the receptacle;

when the plug is selectively connected with the receptacle, each of the first electrical contacts of the first outer contact annulus is in physical contact with a corresponding one of the second electrical contacts of the second outer contact annulus and each of the first electrical contacts of the first inner contact annulus is in physical contact with a corresponding one of the second electrical contacts of the second inner contact annulus;

the plug comprises a central axis;

the first electrical contacts of the first outer contact annulus are resiliently flexible away from the central axis of the plug;

the first electrical contacts of the first inner contact annulus are resiliently flexible toward the central axis of the plug;

the plug further comprises an outer contact retention annulus comprising first ribs, spaced apart from each other in a circular arrangement, and first slots each between adjacent ones of the first ribs;

the plug further comprises an inner contact retention annulus comprising second ribs, spaced apart from each other in a circular arrangement, and second slots each between adjacent ones of the second ribs;

each one of the first electrical contacts of the first outer contact annulus is movably positioned within a corresponding one of the first slots of the outer contact retention annulus; and each one of the first electrical contacts of the first inner contact annulus is movably positioned within a corresponding one of the second slots of the inner contact retention annulus.

2. The electrical connector according to claim 1, wherein:

the receptacle comprises a central axis;

the second electrical contacts of the second outer contact annulus are radially fixed relative to the central axis; and the second electrical contacts of the second inner contact annulus are radially fixed relative to the central axis.

3. The electrical connector according to claim 1, wherein:

an annular space is defined between the first outer contact annulus and the first inner contact annulus of the plug;

the receptacle comprises a support ring interposed between and radially supporting the second outer contact annulus and the second inner contact annulus of the receptacle; and when the plug is selectively connected with the receptacle, the support ring of the receptacle is inserted into the annular space of the plug.

4. The electrical connector according to claim 3, wherein:

the support ring of the receptacle comprises an outer contact retention annulus comprising third ribs, spaced apart from each other in a circular arrangement, and third slots each between adjacent ones of the third ribs;

the support ring of the receptacle further comprises an inner contact retention annulus comprising fourth ribs, spaced apart from each other in a circular arrangement, and fourth slots each between adjacent ones of the fourth ribs;

each one of the second electrical contacts of the second outer contact annulus is fixedly positioned within a corresponding one of the third slots of the outer contact retention annulus of the support ring of the receptacle; and each one of the second electrical contacts of the second inner contact annulus is fixedly positioned within a corresponding one of the fourth slots of the inner contact retention annulus of the support ring of the receptacle.

5. The electrical connector according to claim 1, wherein no portion of the first electrical contacts is plastically deformed.

6. The electrical connector according to claim 1, wherein:

each of the first electrical contacts of the plug comprises a curved contact surface; and when the plug is selectively connected with the receptacle, the curved contact surface of each of the first electrical contacts is in electrical contact with a corresponding one of the second electrical contacts of the receptacle.

7. The electrical connector according to claim 1, wherein the receptacle further comprises:

a housing comprising an interior cavity; and a contact carrier housed within the housing, wherein the second electrical contacts are non-movably fixed to the contact carrier and the contact carrier is non-movably fixed to the housing.

8. An electrical connector, comprising:

a plug comprising first electrical contacts electrically isolated from each other and arranged into a first outer contact annulus and a first inner contact annulus concentric with and radially spaced apart from each other; and a receptacle comprising second electrical contacts electrically isolated from each other and arranged into a second outer contact annulus and a second inner contact annulus concentric with and radially spaced apart from each other;

wherein:

the plug is selectively connectable with the receptacle;

when the plug is selectively connected with the receptacle, each of the first electrical contacts of the first outer contact annulus is in physical contact with a corresponding one of the second electrical contacts of the second outer contact annulus and each of the first electrical contacts of the first inner contact annulus is in physical contact with a corresponding one of the second electrical contacts of the second inner contact annulus;

the plug further comprises:

a housing comprising an interior cavity; and a contact carrier housed within the housing, wherein the first electrical contacts are non-translationally fixed to the contact carrier and the contact carrier is translationally movable relative to the housing.

9. The electrical connector according to claim 8, wherein:

the housing further comprises an alignment aperture;

the contact carrier comprises an alignment tab that extends through and is translationally movable within the alignment aperture;

the receptacle comprises an alignment slot; and when the plug is selectively connected with the receptacle, the alignment tab of the contact carrier is inserted into the alignment slot of the receptacle.

10. The electrical connector according to claim 8, wherein:

the housing further comprises a retention aperture;

the contact carrier further comprises a retention tab that is resiliently flexible and biased to extend through the retention aperture of the housing;

the receptacle comprises a recess; and when the plug is selectively connected with the receptacle, the retention tab of the contact carrier engages the recess of the receptacle.

11. The electrical connector according to claim 10, wherein, when the plug is selectively connected with the receptacle, translational movement of the housing of the plug relative to the contact carrier of the plug in a direction away from the receptacle, causes the housing to engage and resiliently and radially inwardly deform the retention tab to release the retention tab from the recess.

12. The electrical connector according to claim 8, wherein:

the contact carrier further comprises a central receptacle interface radially inward of the first inner contact annulus;

the plug further comprises one of electrical pin receptacles or electrical pins coupled to the central receptacle interface;

the receptacle further comprises a central pin interface that comprises another one of the electrical pin receptacles or the electrical pins; and when the plug is selectively connected with the receptacle, the electrical pin receptacles are electrically coupled with the electrical pins.

13. The electrical connector according to claim 12, wherein the plug further comprises a radio-frequency (RF) shield non-movably fixed to the contact carrier and interposed between the first electrical contacts and the one of the electrical pin receptacles or the electrical pins of the plug.

14. The electrical connector according to claim 13, wherein the RF shield comprises two concentric parts that are radially offset from each other and at least partially overlap each other.

15. The electrical connector according to claim 12, wherein the receptacle further comprises a radio-frequency (RF) shield non-movably fixed to the receptacle and interposed between the second electrical contacts and the other of the electrical pin receptacles or the electrical pins of the receptacle.

16. The electrical connector according to claim 15, wherein the RF shield comprises two concentric parts that are radially offset from each other and at least partially overlap each other.

17. A plug of an electrical connector, the plug comprising:

a first set of electrical contacts electrically isolated from each other and arranged into an outer contact annulus about a central axis of the plug; and a second set of electrical contacts electrically isolated from each other and arranged into an inner contact annulus about the central axis of the plug;

an outer contact retention annulus comprising first ribs, spaced apart from each other in a circular arrangement, and first slots each between adjacent ones of the first ribs;

an inner contact retention annulus comprising second ribs, spaced apart from each other in a circular arrangement, and second slots each between adjacent ones of the second ribs;

wherein:

the inner contact annulus is concentric with and radially spaced apart from the outer contact annulus;

each electrical contact of the first set of electrical contacts of the outer contact annulus is positioned within a corresponding one of the first slots of the outer contact retention annulus; and each electrical contact of the second set of electrical contacts of the inner contact annulus is positioned within a corresponding one of the second slots of the inner contact retention annulus.

18. The plug according to claim 17, wherein:

each electrical contact of the first set of electrical contacts is movable within the corresponding one of the first slots and resiliently flexible; and each electrical contact of the second set of electrical contacts is movable within the corresponding one of the second slots and resiliently flexible.

19. A receptacle of an electrical connector, the receptacle comprising:

an outer contact retention annulus comprising first ribs, spaced apart from each other in a circular arrangement about a central axis of the receptacle, and first slots each between adjacent ones of the first ribs;

an inner contact retention annulus comprising second ribs, spaced apart from each other in a circular arrangement, and second slots each between adjacent ones of the second ribs;

a first set of electrical contacts supported on the outer contact retention annulus, electrically isolated from each other, and arranged into an outer contact annulus about the central axis of the receptacle; and a second set of electrical contacts supported on the inner contact retention annulus, electrically isolated from each other, and arranged into an inner contact annulus about the central axis of the receptacle;

wherein:

the inner contact annulus is concentric with the outer contact annulus;

each electrical contact of the first set of electrical contacts of the outer contact annulus is positioned within a corresponding one of the first slots of the outer contact retention annulus; and each electrical contact of the second set of electrical contacts of the inner contact annulus is positioned within a corresponding one of the second slots of the inner contact retention annulus.

20. The receptacle according to claim 19, wherein:

each electrical contact of the first set of electrical contacts is movable within the corresponding one of the first slots and resiliently flexible; and each electrical contact of the second set of electrical contacts is movable within the corresponding one of the second slots and resiliently flexible.

* * * * *